US010001134B2

(12) United States Patent
Jones et al.

(10) Patent No.: US 10,001,134 B2
(45) Date of Patent: Jun. 19, 2018

(54) ROTOR DISC

(71) Applicant: ROLLS-ROYCE plc, London (GB)

(72) Inventors: Oliver R Jones, Nottingham (GB); Richard A Crofts, Derbyshire (GB)

(73) Assignee: ROLLS-ROYCE plc, London (GB)

( * ) Notice: Subject to any disclaimer, the term of this patent is extended or adjusted under 35 U.S.C. 154(b) by 233 days.

(21) Appl. No.: 15/009,934

(22) Filed: Jan. 29, 2016

(65) Prior Publication Data

US 2016/0238020 A1 Aug. 18, 2016

(30) Foreign Application Priority Data

Feb. 17, 2015 (GB) ..... 1502612.3

(51) Int. Cl.
*F01D 5/06* (2006.01)
*F04D 29/32* (2006.01)
*F01D 5/30* (2006.01)

(52) U.S. Cl.
CPC ..... *F04D 29/322* (2013.01); *F01D 5/06* (2013.01); *F01D 5/063* (2013.01); *F01D 5/30* (2013.01); *F01D 5/303* (2013.01); *F01D 5/3038* (2013.01); *F05D 2220/32* (2013.01); *F05D 2230/239* (2013.01); *F05D 2240/24* (2013.01); *F05D 2260/941* (2013.01)

(58) Field of Classification Search
CPC ..... F01D 5/06; F01D 5/3038; F01D 5/303; F01D 5/063; F04D 29/322
See application file for complete search history.

(56) References Cited

U.S. PATENT DOCUMENTS 2,295,012 A * 9/1942 Semar ..... F01D 5/3038 416/201 R
5,160,242 A * 11/1992 Brown ..... F01D 5/20 416/193 A
5,310,318 A * 5/1994 Lammas ..... F01D 5/3007 416/219 R
5,474,421 A * 12/1995 Rossmann ..... F01D 5/26 416/203

(Continued)

FOREIGN PATENT DOCUMENTS

CN 103850715 A 6/2014
DE 102010001329 A1 8/2011

(Continued)

OTHER PUBLICATIONS

Jul. 27, 2015 Search Report issued in British Patent Application No. 1502612.3.

(Continued)

*Primary Examiner* — Woody Lee, Jr.
(74) *Attorney, Agent, or Firm* — Oliff PLC

(57) ABSTRACT

A rotor disc having an enlarged radially outer rim defining a circumferentially-extending dovetail groove for housing the root portion of a rotor blade. The groove has a groove axis and the groove is unsymmetrical about the groove axis. For example, the dovetail groove may have a restricted radially outer opening extending to an enlarged radially inner bulb profile having a pair of axially opposed curved surfaces and the opposing curved surfaces may unsymmetrical about the groove axis.

18 Claims, 3 Drawing Sheets

(56) References Cited

U.S. PATENT DOCUMENTS

| | | | | |
|---|---|---|---|---|
| 5,584,658 | A * | 12/1996 | Stenneler | F01D 5/3038 416/215 |
| 7,029,237 | B2 * | 4/2006 | Follonier | F01D 5/3038 416/215 |
| 7,708,529 | B2 * | 5/2010 | Klingels | F01D 5/3038 416/220 R |
| 8,932,023 | B2 * | 1/2015 | Hart | F01D 5/32 416/215 |
| 9,068,465 | B2 * | 6/2015 | Keny | F01D 5/32 |
| 2014/0377070 | A1 | 12/2014 | Penalver Castro | |

FOREIGN PATENT DOCUMENTS

| | | | |
|---|---|---|---|
| EP | 2615251 | A1 | 7/2013 |
| GB | 2100809 | A | 1/1983 |

OTHER PUBLICATIONS

Jun. 10, 2016 Search Report issued in European Patent Application No. 16152912.

* cited by examiner

ROTOR DISC

FIELD OF THE INVENTION

The present invention relates to rotor disc such as a rotor disc for supporting a set of compressor blades in a gas turbine engine.

BACKGROUND OF THE INVENTION

With reference to FIG. 1, a ducted fan gas turbine engine is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The compressors each comprise a number of rotor discs, each carrying a set of rotor blades having an aerofoil configuration. The discs are bolted or welded together to form a compressor drum. The rotor blades may be affixed to the discs in an axial or a circumferential fixing arrangement. Circumferential fixing is generally used in the rear stages of the compressors as it is simpler and cheaper (albeit less robust) than axial fixing.

Circumferential fixing involves machining a circumferentially-extending groove around the outer rim of each disc and then slotting the blade roots into the groove.

The circumferentially-extending groove typically has a symmetrical dove-tailed profile with multiple radii in the bulb of the dovetail to minimise stresses within the groove arising from loads applied by the blades. Minimising stresses within the groove allows a reduction in the amount and therefore weight of disc material surrounding the groove. Reduced weight leads to increased engine efficiency.

It is known to provide a bridging section between adjacent rotor discs. The bridging section provides bracing between circumferential grooves on adjacent rotor discs above the gauge plane of the rotor disc and limits distortion under the blade loads in operation. Static vanes can project from an outer casing towards the bridging sections. A spacer portion spaces adjacent rotor discs on an opposing side of the rotor disc to the bridging section.

Reducing the amount of disc material around the circumferentially-extending groove proximal the bridging section leads to a desirable weight reduction as discussed above and, furthermore, reduces stresses at the weld join between adjacent discs by reducing the thermal gradient between the weld and the rim. However, stresses are increased in the thinned area of the rotor disc.

It is a preferred aim of the present invention to provide a disc structure that can minimise the weight of the disc whilst maintaining acceptable stresses for the life of the compressor.

SUMMARY OF THE INVENTION

In a first aspect, the present invention provides a rotor disc having an enlarged radially outer rim defining a circumferentially-extending dovetail groove for housing the root portion of a rotor blade, the groove having a groove axis wherein the groove is unsymmetrical about a radially-extending plane through the groove axis.

A rotor disc e.g. a rotor disc in a compressor drum, has differing stresses and differing structural requirements at opposing axial ends. For example, a circumferential groove in a rotor disc having a bridging section on one axial end, will be braced on the side proximal the bridging section and will experience higher stresses on the side distal the bridging section. Using a circumferential groove that is unsymmetrical about a radially-extending plane through the groove axis allows consideration and accommodation of the differing stresses/structural requirements at opposing axial ends of the rotor disc in order to minimise stresses and thus allow maximum reduction in disc material around the groove.

Optional features of the invention will now be set out. These are applicable singly or in any combination with any aspect of the invention.

A dovetail groove is one that has a restricted radially outer opening extending to an enlarged radially inner bulb profile having two axially opposed curved surfaces.

The radially inner dovetail bulb profile may have two inclined shoulder surfaces extending from the restricted opening to the respective curved surface. The two curved surfaces may be joined by a planar surface forming the base of the groove.

The curved surfaces may be unsymmetrical about the radially-extending plane through groove axis, for example, one of the curved surfaces may be a multi-radii surface whilst the other has a single radius and/or the radius of one of the curved surfaces may be greater than the radius (radii) of the other curved surface.

Each curved surface may have a respective radially outer section and radially inner section.

The radially outer sections and/or the radially inner sections of the curved surface may both/each be unsymmetrical about the radially-extending plane through groove axis.

In some embodiments, the rotor disc further comprises a bridging section for connection (e.g. by welding) to an adjacent rotor disc. In some embodiments, the bridging section extends axially from the radially outer rim such that its radially outer surface is radially aligned with or radially outwards of the opening of the groove i.e. above the gauge plane of the disc.

In some embodiments, the curved surface proximal to the bridging section has a greater radius of curvature than the curved surface distal the bridging section.

In some embodiments, the curved surface distal the bridging section has a multi-radii profile. This helps reduce stresses in the areas that are not braced by the bridging section.

In some embodiments, the radially inner sections of the curved surfaces each have a respective radius with the radially inner section of the curved surface proximal the bridging section having a greater radius than the curved surface distal the bridging section i.e. the inner sections of the curved surfaces are unsymmetrical about the radially extending plane through the groove axis.

In some embodiments, the radially outer section of the curved surface proximal the bridging section has a single radius and the radially outer section of the curved surface distal the bridging section is a multi-radii surface i.e. the outer sections of the curved surfaces are unsymmetrical about the radially extending plane through the groove axis.

The enlarged outer rim of the rotor disc has an exterior surface.

In some embodiments, the distance from the groove to the exterior surface of the rim proximal the bridging section is less than the distance from the groove to the exterior surface of the rim distal the bridging section.

In a second aspect, the present invention provides a compressor drum having at least one rotor disc according to the first aspect.

In some embodiments, the compressor drum comprises two rotor discs according to the first aspect with the two rotor disc arranged adjacent one another with the bridging sections joined e.g. by bolting or welding (such as inertia welding).

In a third aspect, the present invention provides a gas turbine engine having a rotor disc according to the first aspect or a compressor drum according to the second aspect.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
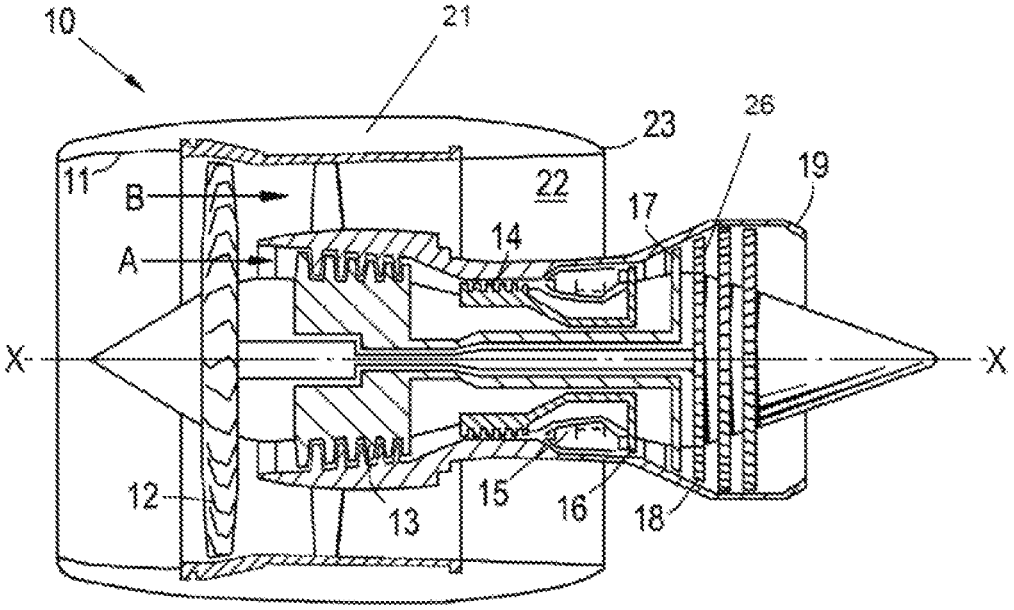
FIG. 1 shows a ducted fan gas turbine engine.
Figure 2:
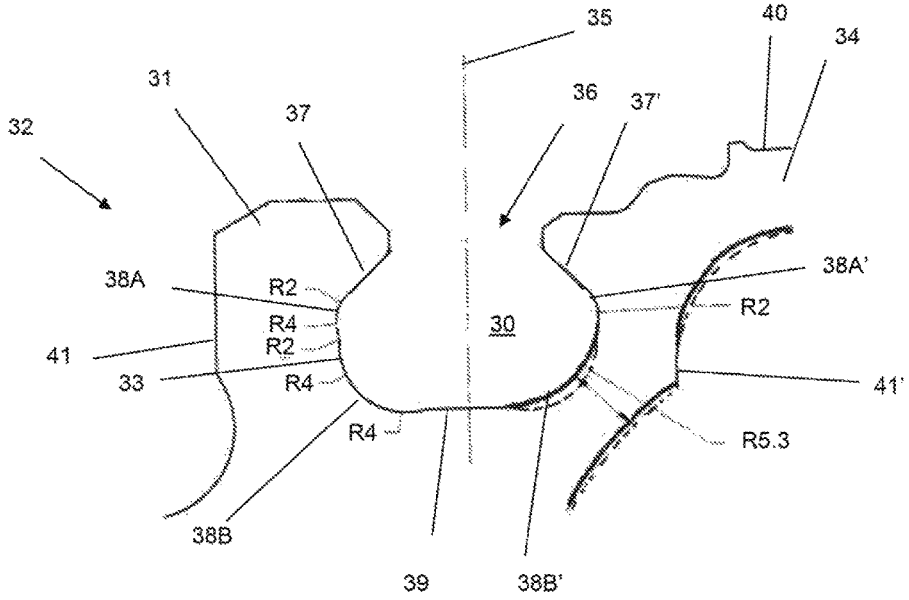
FIG. 2 shows a radially outer portion of a rotor disc according to a first embodiment of the present invention with dotted lines showing a radially outer portion of a prior art rotor disc.

FIG. 2 shows the radially outer portion of a rotor disc 32 having an enlarged radially outer rim 31 defining a circumferentially-extending dovetail groove 30 for housing the root portion of a rotor blade (not shown). The groove has a groove axis and the groove 30 is unsymmetrical about a radially extending plane 35 through the groove axis as discussed below.

The dovetail groove 30 has a restricted radially outer opening 36 extending to an enlarged radially inner bulb profile 33.

The radially inner dovetail bulb profile 33 has two inclined shoulder surfaces 37, 37' extending from the restricted opening 36 to a respective curved surface. The two curved surfaces are axially opposed (across the axis of the rotor disc) and are joined by a planar surface 39 forming the base of the groove 30 (radially opposite the restricted opening).

Each curved surface has a respective radially outer section 38A, 38A' and radially inner section 38B, 38B'.

Figure 3:
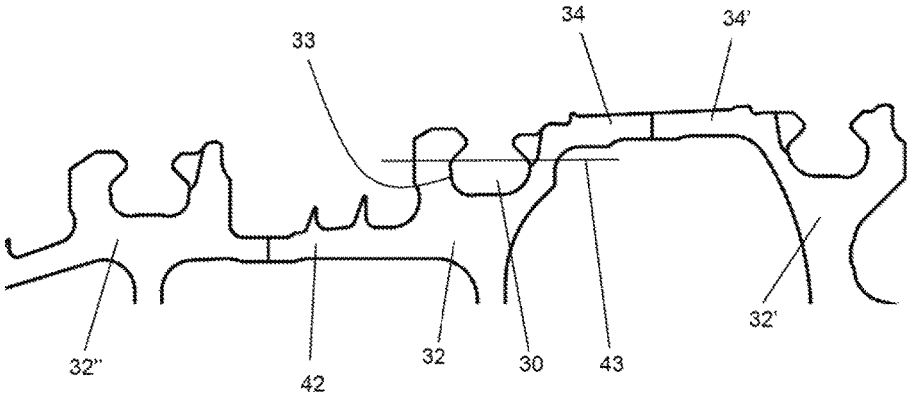
FIG. 3 shows three adjacent rotor discs with two of the rotor discs being according to the first embodiment of the present invention.

As shown in FIGS. 2 and 3, the rotor disc 32 further comprises a bridging section 34 for connection (e.g. by inertia welding) to an adjacent rotor disc 32'. The bridging section 34 extends axially from the radially outer rim 31 such that its radially outer surface 40 is radially aligned with or radially outwards of the opening 36 of the groove 30 i.e. above the gauge plane of the rotor disc. The bridging section 34 abuts a bridging section 34' on the adjacent rotor disc 32' and the bridging sections 34, 34' act to provide bracing between the circumferential grooves on adjacent rotor discs 32, 32' above the gauge plane 43 of the rotor disc 32 and to limit distortion under the blade loads in operation. A spacer portion 42 is provided between the rotor disc 32 and another rotor disc 32" on the opposing side of the circumferential groove 30 to the bridging section 34.

The radially outer section 38A' of the curved surface proximal the bridging section 34 has a single radius (R2) whilst the radially outer section 38A of the curved surface distal the bridging section 34 has a multiple radii (R2 and R4) i.e. the outer sections 38A, 38A' of the curved surfaces are unsymmetrical about radially extending plane 35 through the groove axis.

The radially inner sections 38B, 38B' of the curved surfaces both have a single radius with the radially inner section 38B' of the curved surface proximal the bridging section 34 having a greater radius of curvature (R5.3) than the radius of curvature (R4) of the radially inner section 38B of the curved surface distal the bridging section 34 i.e. the inner sections 38B, 38B' of the curved surfaces are unsymmetrical about the radially extending plane 35 through the groove axis.

The enlarged outer rim 31 of the rotor disc 32 has an exterior surface 41 distal the bridging portion 34 and an exterior surface 41' proximal the bridging section 34. The distance from the groove 30 to the exterior surface 41' of the rim 31 proximal the bridging section 34 is less than the distance from the groove 30 to the exterior surface 41 of the rim 31 distal the bridging section 34.

The dotted lines in FIG. 2 show a radially outer portion of a prior art rotor disc with a symmetrical circumferential groove. It can be seen that the change in shape of the circumferential groove allows material to be removed from the exterior surface 41' which, in turn reduces component weight and stresses at the weld join. The amount of material that can be removed is greater than the amount of material that is added as a result of having a greater radius of curvature in the radially inner section 38B' of the curved surface proximal the bridging section 34 thus resulting in a reduction in component weight.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention.

The invention claimed is:

1. A rotor disc having an enlarged radially outer rim defining a circumferentially-extending dovetail groove for housing the root portion of a rotor blade, the groove having a groove axis wherein the groove is unsymmetrical about a radially-extending plane through the groove axis, wherein the dovetail groove has a pair of axially opposed curved surfaces on opposite sides of the radially-extending plane, a first one of the pair of opposing curved surfaces is a multi-radii surface while a second one of the pair of opposing curved surfaces has a single radius, and the multiple radii of the multi-radii surface vary with respect to a same direction from the multi-radii surface.

2. The rotor disc according to claim 1 wherein the dovetail groove has a restricted radially outer opening extending to an enlarged radially inner bulb profile having the pair of axially opposed curved surfaces.

3. The rotor disc according to claim 2 wherein the radius of the first one of the opposing curved surfaces is greater than the radius (radii) of the second one of the curved surfaces.

4. The rotor disc according to claim 2 wherein each curved surface has a respective radially outer section and radially inner section.

5. The rotor disc according to claim 4 wherein the radially outer sections and the radially inner sections of the curved surface are unsymmetrical about the radially-extending plane through the groove axis.

6. The rotor disc according to claim 4 wherein the radially outer sections or the radially inner sections of the curved surface are unsymmetrical about the radially-extending plane through the groove axis.

7. The rotor disc according to claim 1 wherein the opposing curved surfaces are unsymmetrical about the radially-extending plane through the groove axis.

8. The rotor disc according to claim 1 further comprising a bridging section for connection to an adjacent rotor disc.

9. The rotor disc according to claim 8 wherein the bridging section extends from the radially outer rim such that its radially outer surface is radially outwards of the opening of the groove.

10. The rotor disc according to claim 8 wherein the dovetail groove has a restricted radially outer opening extending to an enlarged radially inner bulb profile having the pair of axially opposed curved surfaces and wherein the curved surface proximal the bridging section has a greater radius of curvature than the curved surface distal the bridging section.

11. The rotor disc according to claim 8 wherein the dovetail groove has a restricted radially outer opening extending to an enlarged radially inner bulb profile having the pair of axially opposed curved surfaces and wherein the curved surface distal the bridging section has a multi-radii profile.

12. The rotor disc according to claim 8 wherein:

the dovetail groove has a restricted radially outer opening extending to an enlarged radially inner bulb profile having the pair of axially opposed curved surfaces;

each curved surface has a respective radially outer section and radially inner section; and the radially inner sections of the curved surfaces each have a respective radius with the radially inner section of the curved surface proximal the bridging section having a greater radius than the curved surface distal the bridging section.

13. The rotor disc according to claim 8 wherein:

the dovetail groove has a restricted radially outer opening extending to an enlarged radially inner bulb profile having the pair of axially opposed curved surfaces;

each curved surface has a respective radially outer section and radially inner section; and the radially outer section of the curved surface distal the bridging section has a multi-radii surface.

14. The rotor disc according to claim 8 wherein a distance from the groove to an exterior surface of the rim proximal the bridging section is less than the distance from the groove to an exterior surface of the rim distal the bridging section.

15. A compressor drum comprising at least one rotor disc according to claim 1.

16. A compressor drum comprising two rotor discs according to claim 1, each of the two rotor discs including a bridging section for connection to an adjacent rotor disc, the two rotor discs being arranged adjacent one another with the bridging sections joined.

17. A gas turbine engine comprising a rotor disc according to claim 1.

18. A gas turbine engine comprising a compressor drum, the compressor drum including at least one rotor disc according to claim 1.

* * * * *